US006430366B1

(12) United States Patent
Mizutani et al.

(10) Patent No.: US 6,430,366 B1
(45) Date of Patent: Aug. 6, 2002

(54) WATER HEATING APPLIANCE WITH TIPOVER AND FLOAT SWITCHES

(75) Inventors: Masataka Mizutani; Nobuyuki Tanaka; Atsushi Sawaki, all of Aichi (JP)

(73) Assignees: Inax Corporation, Tokoname; Aisin Seiki Kabushiki Kaisha, Kariya, both of (JP)

( * ) Notice: Subject to any disclaimer, the term of this patent is extended or adjusted under 35 U.S.C. 154(b) by 0 days.

(21) Appl. No.: 08/701,676

(22) Filed: Aug. 22, 1996

Related U.S. Application Data

(63) Continuation-in-part of application No. 08/638,048, filed on Apr. 26, 1996, now abandoned.

(30) Foreign Application Priority Data

Jun. 5, 1995 (JP) ..... H7-137687
May 31, 1996 (JP) ..... H8-138411

(51) Int. Cl.[7] ..... E03D 9/08
(52) U.S. Cl. ..... 392/449; 4/447
(58) Field of Search ..... 392/449–454, 392/458, 441; 122/13.1, 13.2, 5.4; 126/361, 362, 344; 4/447

(56) References Cited

U.S. PATENT DOCUMENTS 4,835,365 A * 5/1989 Etheridge ..... 392/489
5,271,104 A * 12/1993 LaTora ..... 4/447
5,911,516 A * 6/1999 Chang ..... 4/447

FOREIGN PATENT DOCUMENTS

| | | | | |
|---|---|---|---|---|
| AU | 6359 | * | 3/1933 | ..... 392/450 |
| DE | 457486 | * | 3/1928 | ..... 392/451 |
| DE | 1254265 | * | 11/1967 | ..... 392/449 |
| GB | 679921 | * | 9/1952 | ..... 392/450 |
| JP | 5-21222 | * | 8/1993 | |
| JP | 6-201195 | * | 7/1994 | |
| JP | 6-201196 | * | 7/1994 | |

* cited by examiner

*Primary Examiner*—John A. Jeffery
(74) *Attorney, Agent, or Firm*—Kanesaka & Takeuchi

(57) ABSTRACT

One hundred volt AC power is conducted from a plug to a heater of a water tank through 100V lines. The 100V lines are provided with an electricity supply controlling element. Direct current 5V is conducted from the 100V lines to a microcomputer 15 through a power-supply circuit formed with a transformer, a rectifier circuit and the like. The electricity supply controlling element receives a control signal through the signal line to keep the water temperature in the water tank at a predetermined temperature. The signal line is provided with a tipover switch and a float switch on the way thereof, thereby securely stopping the operation of the electricity supply controlling element when the water tank is tilted or turned over. The tipover switch is one with a smaller capacity, thereby reducing its cost.

5 Claims, 7 Drawing Sheets

WATER HEATING APPLIANCE WITH TIPOVER AND FLOAT SWITCHES

CROSS REFERENCE TO RELATED APPLICATION

This is a continuation-in-part application of patent application Ser. No. 08/638,048 filed on Apr. 26, 1996, now abandoned.

FIELD OF THE INVENTION AND RELATED ART STATEMENT

The present invention relates to a water heating appliance for heating water stored in a water tank to make hot or warm water, such as a buttocks washer disposed on a water closet for washing the buttocks with warm water and an electric calorifier disposed on a vanity cabinet. More particularly, the present invention relates to a water heating appliance which is designed to cut off the supply of electricity when the tank is tilted or turned over.

A conventional buttocks washer disposed on a water closet for washing the buttocks with warm water is shown in FIG. 3. The buttocks washer has a water tank 3 integrally provided with a spray nozzle 2 within a casing 1 disposed on the top surface of a rear portion of the stool or water closet. The water tank 3 heats water supplied from an outside water supply pipe by a heater 4 to a predetermined temperature.

For keeping water in the water tank 3 at a predetermined temperature and for preventing undesirably increasing its temperature, the water tank 3 is provided with a thermostat 5 for controlling the water temperature upon turning on or off the heater 4 according to the water temperature, and a thermal fuse 6 for preventing overheating the water upon shutting off the circuit when the water temperature exceeds a predetermined degree, which are disposed on an outer wall surface of the water tank 3.

The water tank 3 is also provided with a float switch 7 therein for allowing the supply of electricity to the heater 4 when the water level exceeds a predetermined level. As the water level is lowered below the predetermined level during the supply of electricity to the heater 4, the contact of the float switch 7 is opened to cut off the supply of electricity to the heater 4.

As for the buttocks washer as shown in FIG. 3, even when the water tank 3 has no water stored therein, the float switch 7 is forcibly turned on when the washing fixture is tilted or turned over. Then, a water heating appliance which has a mechanism for cutting off the supply of electricity to the heater when the tank is tilted or turned over (Japanese patent application No. H6-341090, filed Dec. 28, 1994, hereinafter, referred to as "the prior application") has been proposed by the applicants of the present invention.

The water heating appliance of the prior application is provided with a tipover switch on a main circuit (for example, a 100V line) for supplying electricity from a commercial power source to the heater. The contact of the tipover switch is designed to be opened when the tank is tilted or turned over, thereby cutting off the supply of electricity to the heater.

However, the water heating appliance of the prior application needs the tipover switch having great current carrying capacity in order to open and close the 100V line.

OBJECT AND SUMMARY OF THE INVENTION

It is an object of the present invention to provide a water heating appliance in which a tipover switch with smaller current carrying capacity is employed.

A water heating appliance of the present invention comprises: a tank, a heater disposed on the tank, a main circuit for connecting the heater to a commercial power source an electricity supply controlling element disposed on the main circuit, a controller for outputting a control signal for controlling the electricity supply controlling element, a signal line for transmitting the control signal of the controller to the electricity supply controlling element and a tipover switch disposed on the signal line to open a contact thereof when the tank is tilted or turned over.

According to the present invention, the tipover switch is disposed on the signal line for transmitting the control signal from the controller to the electricity supply controlling element so that the electricity supply controlling element may stop supplying the heater with electricity since the tipover switch opens its contact when the tank is tilted or turned over.

Since the current conducted through the signal line is small (20 mA) and further its voltage is low (5V), the tipover switch with smaller capacity can be employed.

Since the current is very small and the voltage is low, the tipover switch is reduced its capacity remarkably.

DESCRIPTION OF THE PREFERRED EMBODIMENTS

Figure 1:
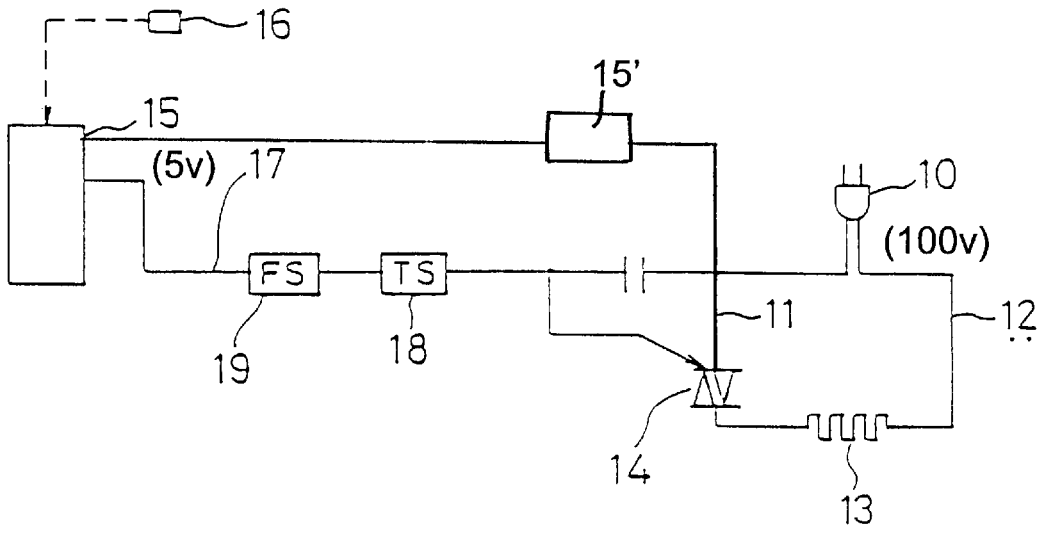
FIG. 1 is a circuit diagram of a water heating appliance according to an embodiment of the present invention.

FIG. 1 is a circuit diagram of a water heating appliance used for a buttocks washer for washing the anus and therearround with warm water according to an embodiment of the present invention. The alternating current (AC) 100V is conducted from a plug 10 to a heater 13 of a water tank (not shown) through 100V lines 11, 12 forming a main circuit. The 100V line 11 is provided with an electricity supply controlling element 14, such as TRIAC.

The direct current (DC) 5V is conducted from the 100V lines 11, 12 to a microcomputer 15 through a constant-power circuit 151 formed with a transformer, a rectifier circuit and the like. The microcomputer 15 receives a water temperature signal from a water temperature sensor 16 sensing the water temperature in the water tank, and outputs a control signal through a signal line 17 to the electricity supply controlling element 14 to make the water temperature in the water tank at a predetermined temperature.

The signal line 17 is provided with a tipover switch 18 and a float switch 19 on its way. The tilt angle where the tipover switch 18 turns off (i.e. opens its contact) can be set optionally but, preferably, set to an angle of more than 25 degrees from a horizontal plane.

The components employed for manufacturing the water heating appliance are as follows: the heater 13 has a capacity of 570 watts; the tipover switch 18 is YKS1B manufactured by SAGAMI ELECTRIC Co. Ltd. which cuts off the supply of electricity when the water tank is tilted at an angle of more than 60° the float switch 19 is HYR 2003 manufactured by NIPPON ALEPH Co. Ltd.; the TRIAC 14 is TM1241S-L manufactured by SANKEN ELECTRIC Co. Ltd.; the microcomputer 15 is M37470M4 manufactured by Mitsubishi Corporation; and the water temperature sensor 16 is ES-51F manufactured by Sibaura Electronic Co. Ltd. The capacity of the condenser shown in FIG. 1 is 0.1 $\mu$F.

In the water heating appliance as structured above, the float switch 19 turns off when the water level in the water tank is lower than the heater in the tank. In such a condition the electricity supply controlling element 14 does not operate, whereby the supply of electricity to the heater 13 is cut off. When the water tank is tilted or turned over in case of the float switch 19 being ON, the tipover switch 18 turns off not to operate the electricity supply controlling element 14 so that the supply of electricity to the heater 13 is cut off.

Since the tipover switch 18 is disposed on the signal line 17 as mentioned above, a tipover switch with smaller current carrying capacity is enough to be employed as the tipover switch 18 because the tipover switch 18 cuts off the electricity of a low voltage (for example DC 5V) and a low current (for example 20 mA) from the microcomputer 15.

It is programmable that the signal of the tipover switch is inputted into the microcomputer to stop the operation of the electricity supply controlling element when the tank is titled or turned over according to logical decisions by the microcomputer. However, in this case, there is a possibility of the microcomputer failure so that the electricity supply controlling element can not be stopped when the tank is tilted or turned over. According to the present invention, the electricity supply controlling element 14 can be stopped whenever the tank is tilted or turned over.

Figure 2:
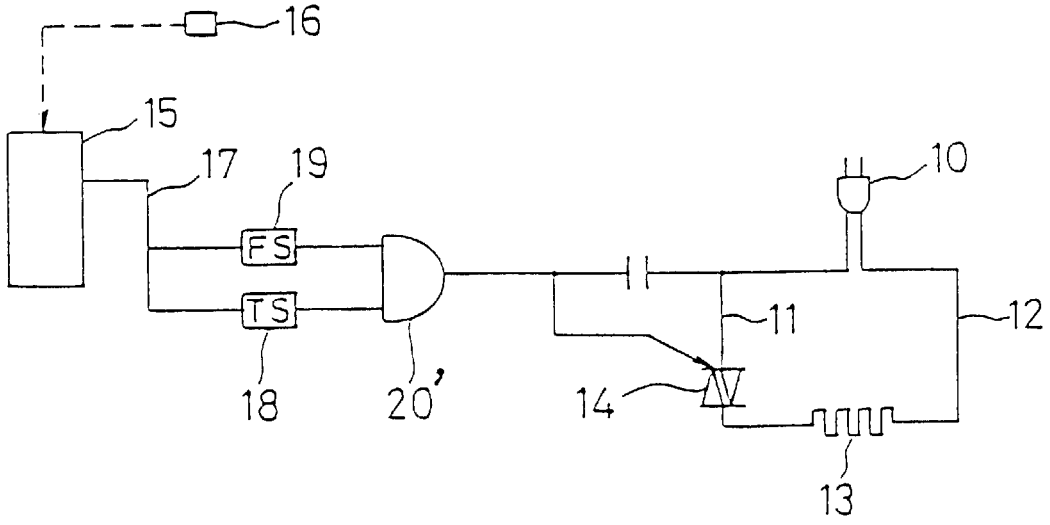
FIG. 2 is a circuit diagram of a water heating appliance according to another embodiment.
Figure 3:
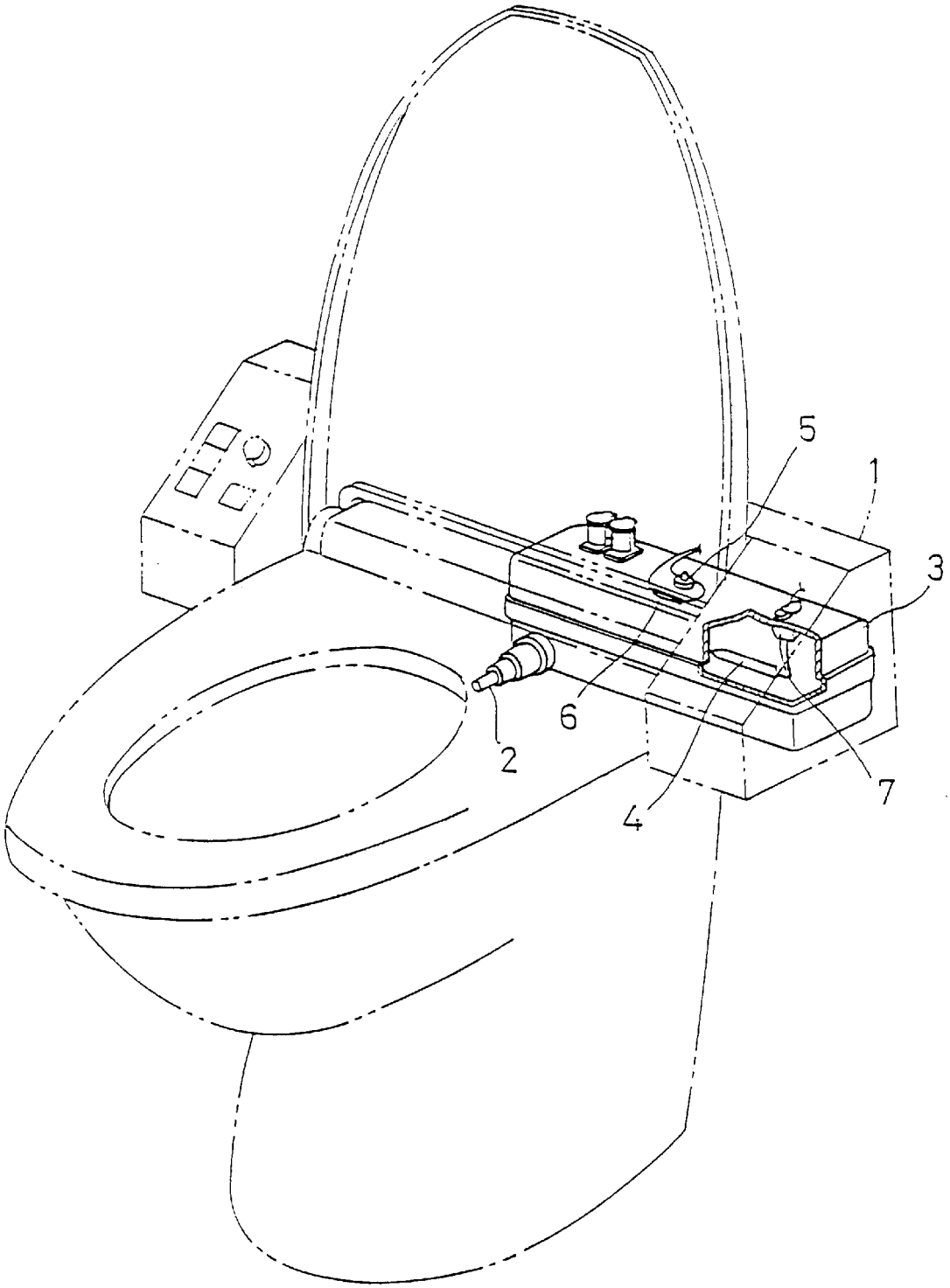
FIG.3 PRIOR ART
FIG. 3 is a perspective view of a conventional water heating appliance.

FIG. 2 is a circuit diagram of a water heating appliance according to another embodiment of the present invention wherein a signal line 17 is branched out into two lines on its way and a float switch 19 and a tipover switch 18 are arranged in parallel. Outputs of the float switch 19 and the tipover switch 18 are entered into an electricity supply controlling element 14 through an AND circuit 20'. Also in this embodiment, the electricity supply controlling element 14 is operable only when the float switch is ON and the tank is not titled. Also in this embodiment, the tipover switch 18 is disposed on the way of the signal line 17, thereby giving the same effect as the above embodiment.

It should be understood that the main circuit (100V line) may be provided with a safety thermostat and a thermal fuse, but not shown.

As mentioned above, the water heating appliance of the present invention can reliably stop the operation of the electricity supply controlling element when the tank is titled or turned over.

For the tipover switch 18, a combination of a roll-able conductive ball with a pair of terminals, a combination of a tilt-able weight with a pair of terminals, a combination of a gyro motor with a potentiometer, a combination of a movable coil type meter unit with a photo coupler, or the like may be employed.

Figure 4:
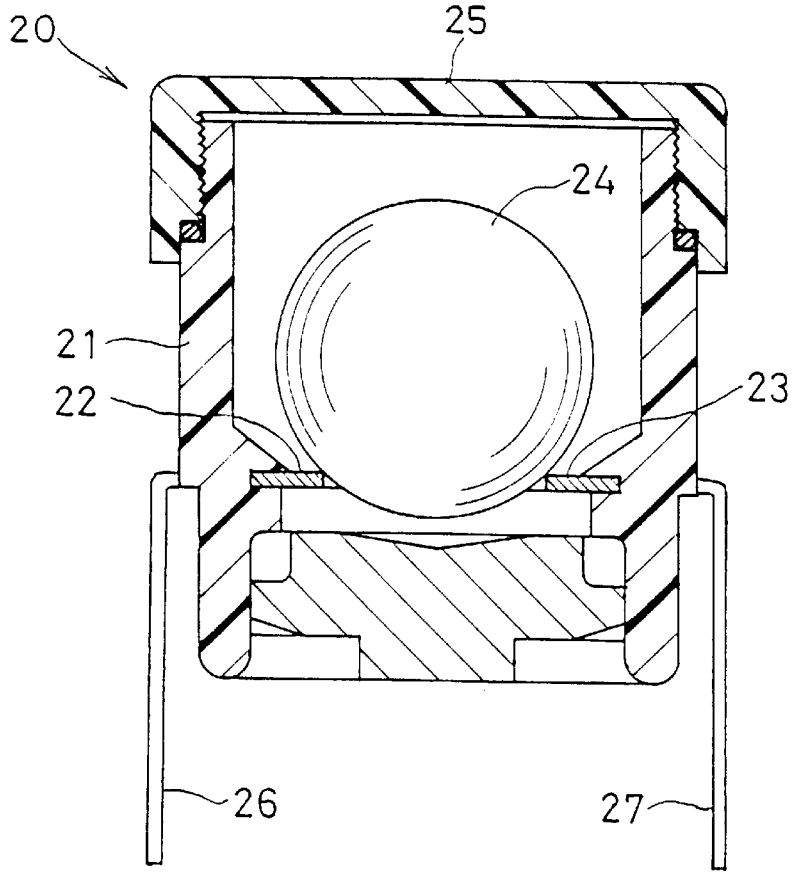
FIG. 4 is a sectional view of a tipover switch.
Figure 5:
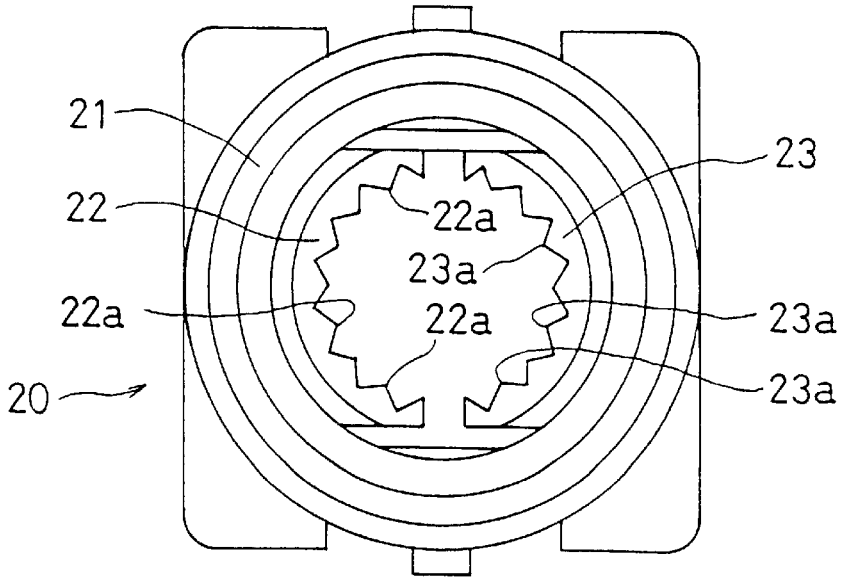
FIG. 5 is a plan view showing an internal structure of the tipover switch shown in FIG. 4.

FIG. 4 is a vertical view of a tipover switch comprising a pair of terminals and a conductive ball and FIG. 5 is a plan view showing the inner structure of the tipover switch.

The tipover switch 20 comprises a rough cylindrical housing 21 made of a synthetic resin and a pair of terminals 22, 23 is disposed inside the housing 21. The terminals 22, 23 are each formed in an arc-like shape and are disposed in such a manner that inner peripheries thereof face is each other to form an annulus ring about the axis of the housing 21.

A conductive ball 24 is disposed on the terminals 22, 23. The ball 24 is a steel ball the surface of which plated with gold. It should be noted that the surfaces of the terminals 22, 23 are also plated with gold.

The inner peripheries of the terminals 22, 23 are serrated to have tips 22*a*, 23*a* protruding form the inner surfaces thereof. The tips 22*a*, 23*a* are spaced equally from the center of the housing 21. The tips 22*a* or the tips 23*a* are placed at intervals, i.e. distances between adjacent tips 22*a* or adjacent tips 23*a* are all the same.

The housing 21 is fitted with a cap 25 thereon. It should be noted that FIG. 5 is a plan view of the housing 21 without the cap 25 and the ball 24.

The housing 21 has reed pins 26, 27 extending therefrom which are connected to the terminals 22, 23, respectively.

When the tipover switch 20 structured above stands straight, as shown in FIG. 4, the center of the ball 24 is positioned on the axis of the housing 21 and the ball 24 is in contact with all tips 22*a*, 23*a* of both terminals 22, 23, thereby making the resistance (electric resistance) between the terminals 22 and 23 the lowest.

When the tipover switch 20 tilts, the center of the ball 24 is deflected from the axis of the housing 21. As a result, the ball 24 is in contact with the reduced number of the tips 22*a*, 23*a*, thereby making the resistance between the terminals 22 and 23 higher. The greater the tilting angle of the tipover switch 20, the smaller the number of the tips 22*a*, 23*a* in contact with the ball 24. By measuring the resistance between the terminals 22 and 23, the tilting angle of the tipover switch 20 can be detected.

Figure 6:
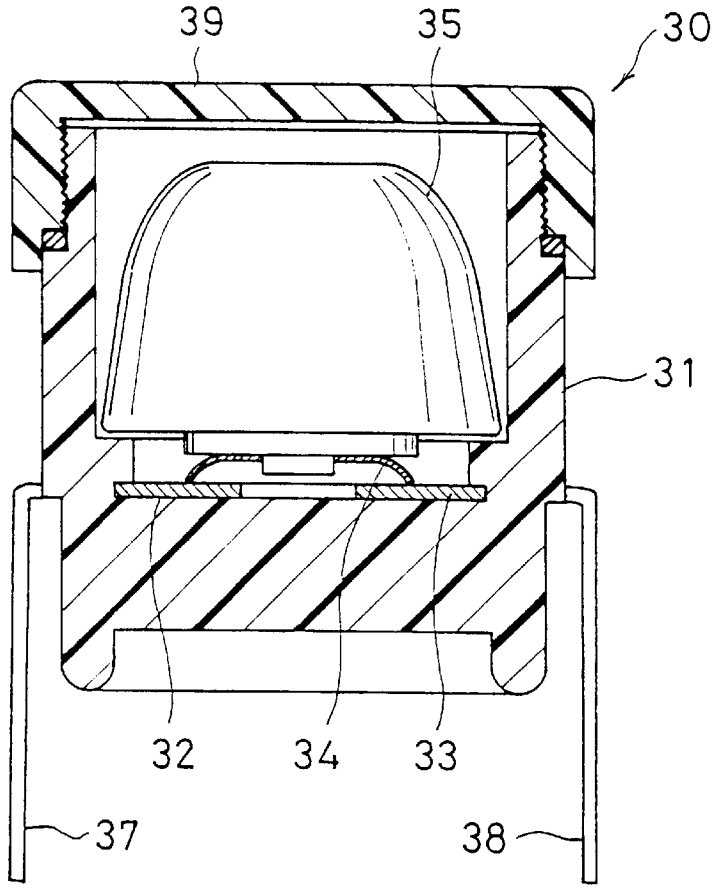
FIG. 6 is a sectional view of another tipover switch.
Figure 7:
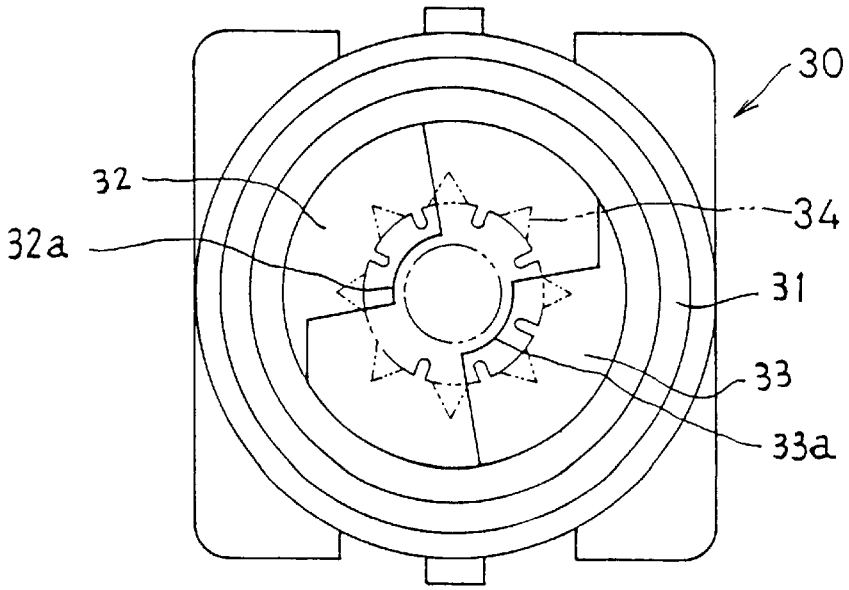
FIG. 7 is a plan view showing an internal structure of the tipover switch shown in FIG. 6

FIG. 6 is a vertical sectional view showing another tipover switch 30 and FIG. 7 is a plan view showing the inner structure of the tipover switch 30. It should be noted that FIG. 7 is a plan view showing the tipover switch without a cap and a weight with a contact metal being shown by two-dot lines.

The tipover switch 30 comprises a rough cylindrical housing 31 and a pair of terminals 32, 33 inside the housing 31. The terminals 32, 33 are each made of a metal plate formed in a rough fun configuration and plated with gold.

The terminals 32, 33 have concave arc-like inner peripheries 32*a*, 33*a*, respectively and are disposed in such a manner that inner peripheries 32*a*, 33*a* face each other to form an annulus ring about the axis of the housing 31.

Figure 8:
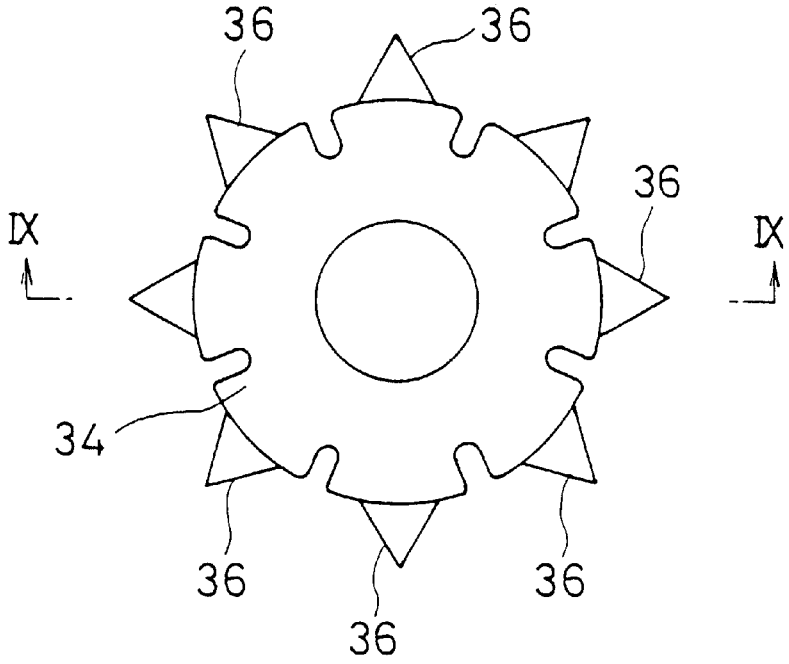
FIG. 8 is a plan view of a contact metal.
Figure 9:
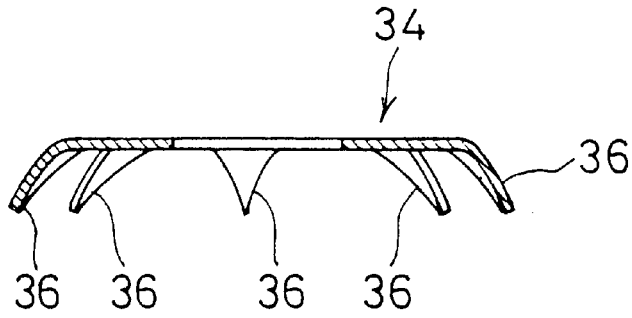
FIG. 9 is a sectional view taken along the line IX—IX of FIG. 8.

The contact metal 34 shown in FIGS. 8, 9 is disposed on the terminals 32, 33. The contact metal 34 is fixed to the bottom of a truncated cone-like weight 35. The contact metal 34 is provided with a plurality of (eight in these figures) triangular legs 36 disposed on the periphery thereof at intervals. The contact metal 34 is also made of a metal plate plated with gold. The housing 31 has reed pins 37, 38 extending therefrom which are connected to the terminals 32, 33, respectively. The housing 31 is fitted with a cap 39 thereon.

When the tipover switch 30 structured above stands straight, as shown in FIG. 7, two of the legs 36 are in contact with each terminal 32, 33, thereby making the resistance (electric resistance) between the terminals 32 and 33 the lowest. In this state, the axis of the housing 31 is the same as that of the weight 35.

When the tipover switch 30 tilts, the axis of the weight 35 is deflected from the axis of the housing 31. As a result, the terminals 32, 33 a number of in contact with the legs 36 is reduced thereby making the resistance between the terminals 32 and 33 higher. The greater the tilting angle of the tipover switch 30, the smaller the number of the legs 36 in contact with the terminals 32, 33 and the greater the resistance between the terminals 32, 33. By measuring the resistance between the terminals 32 and 33, the tilting angle of the tipover switch 30 can be detected.

By the way, when the tank is turned over (i.e. tilted at an angle of 90°), the float of the float switch sometimes moves laterally along with the surface of the water so that the float switch is turned ON. In such a case, during gradually decreasing the tilting angle from 90° to stand up the tank, the float might stick to the inner surface of the float switch due to its surface tension when the tilting angle of the tank is still close to 90° (e.g. between 90° and 60°) so that the float switch is still ON.

Therefore, it is preferable that the tipover switch has characteristics that turns OFF whenever the tilting angle of the tank is equal or more than 60°.

The tipover switch has an error of about ±10° in the tilting angle to be actually turned OFF. Therefore, it is preferable to use a tipover switch, OFF angle of which 45° as the tipover switch can be securely turned OFF at the tilting angle of 60°.

According to the present invention, the tipover switch with a smaller capacity can be employed, thereby reducing its cost.

Figure 10:
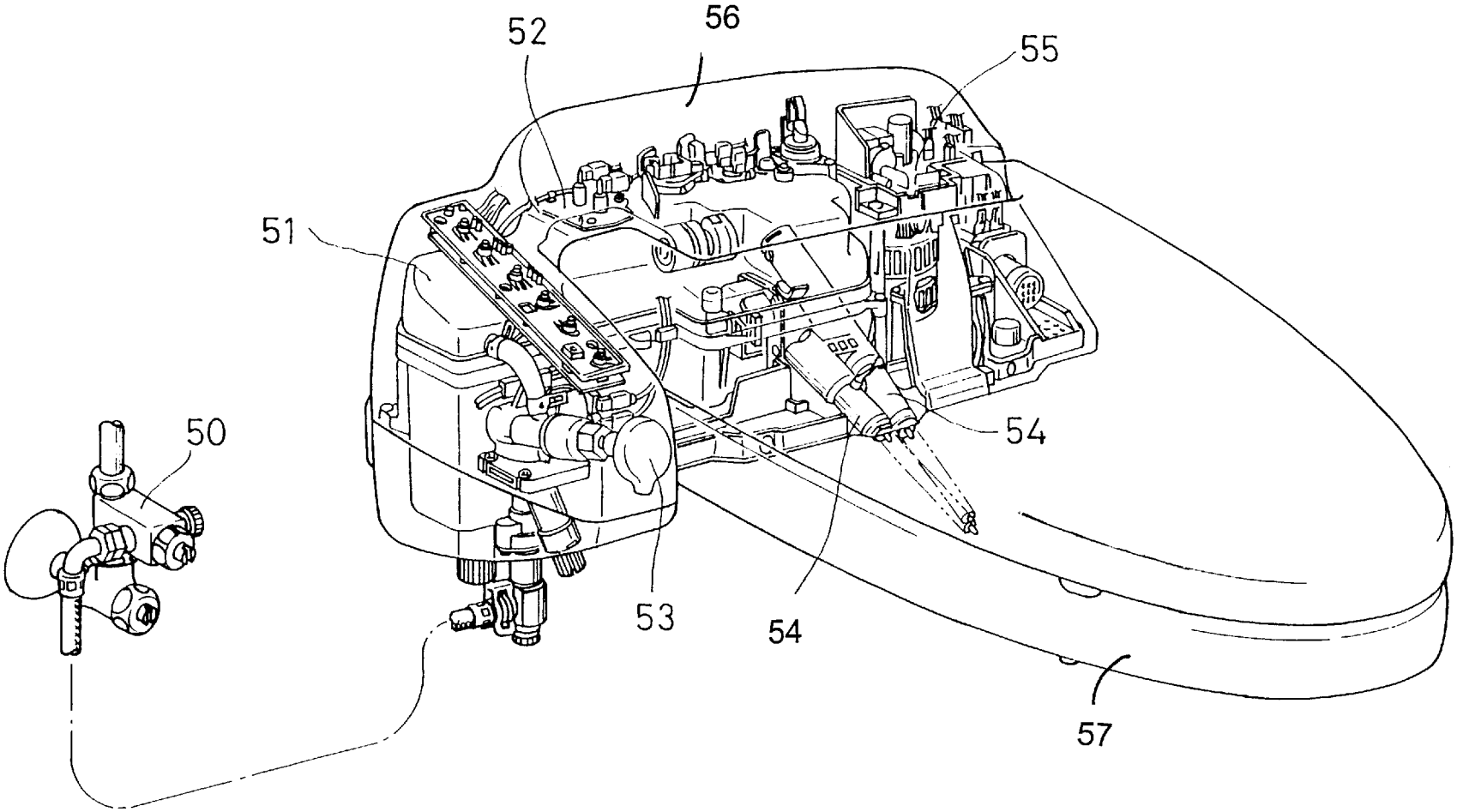
FIG. 10 is a perspective view of a buttocks washer.

FIG. 10 shows a perspective view of a bottocks washer provided with a water heating appliance of the present invention, which is installed in a casing 56 with a toilet seat 57.

Figure 11:
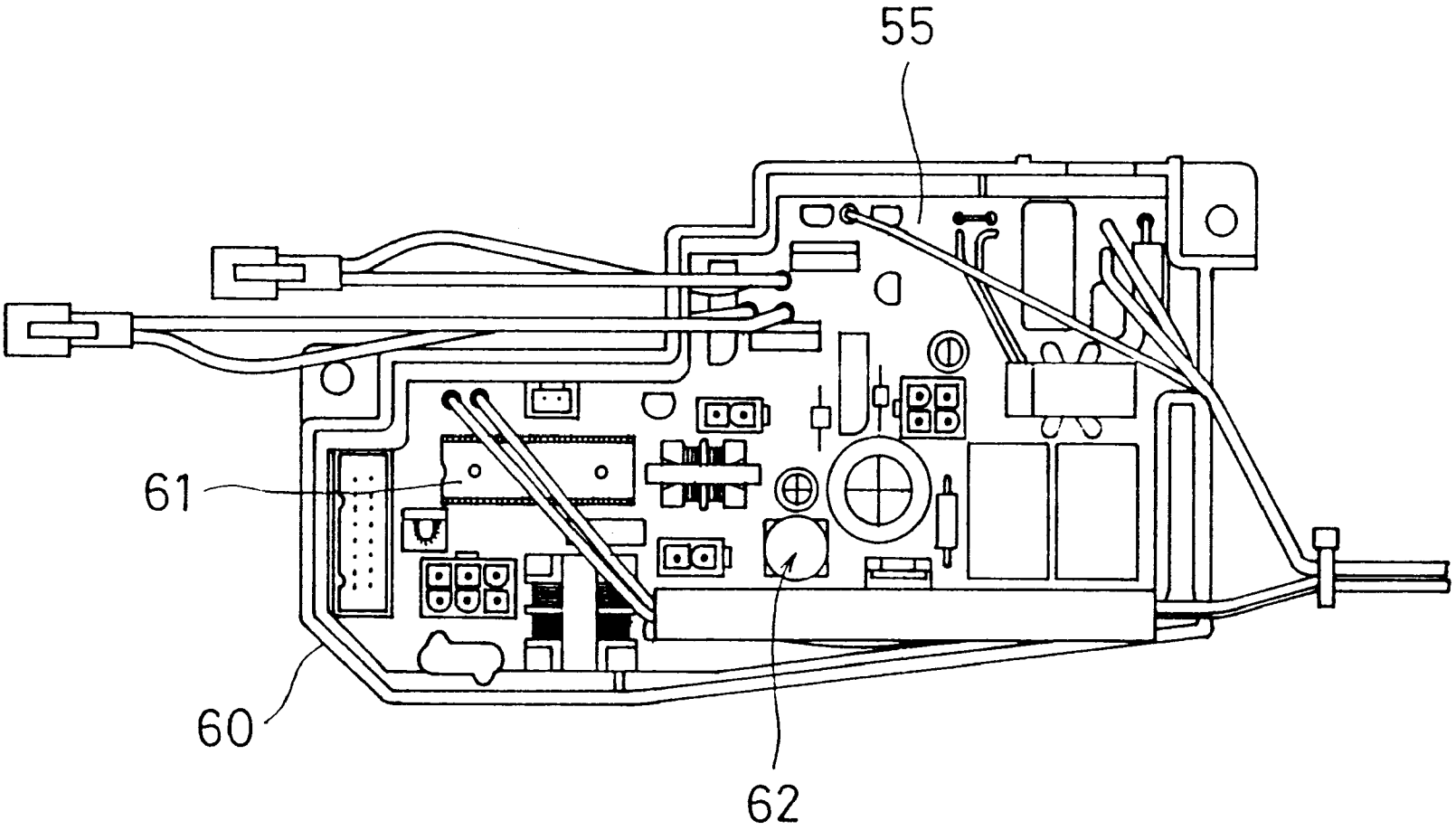
FIG. 11 is a plan view of a base plate provided with the tipover switch.

Tap water is fed from a valve to a water tank 51 provided with a water heater 52 via an adjustable valve 53. Warm water is supplied from the tank 51 to either of washing nozzles 54, 55 when a washing switch is operated. As shown in FIG. 11 a tipover switch 62 is installed on a base plate in a casing 60. A micro computer 61 is also installed on the plate 55.

What is claimed is:

1. A water heating appliance for washing a part of a body, comprising:

a toilet seat adapted to be disposed on a stool;

a casing disposed on a rear part of the toilet seat;

a tank for storing water situated in the casing;

a spray nozzle attached to the tank and situated in the casing;

a heater disposed in the tank;

a main circuit for connecting the heater to a commercial power source;

an electricity supply controlling element disposed in said main circuit, said electricity supply controlling element controlling a supply of electricity directly received from the commercial power source to the heater to regulate the same;

a controller for outputting a control signal to control the electricity supply controlling element, said control signal having a voltage and current less than the voltage and current provided by the commercial power source;

a signal line situated between the electricity supply controlling element and the controller formed separately from the main circuit, said signal line transmitting the control signal of said controller to said electricity supply controlling element;

a tipover switch disposed in said signal line and having a contact, said contact having means for opening the signal line by a weight thereof responsive to said tank being tilted or turned over so that whenever the tank is tilted or turned over, electricity in the main circuit is not supplied to the heater by the electricity supply controlling element; and a float switch disposed in said signal line to cut off the supply of electricity responsive to a water level in the tank being lower than a predetermined level by the electricity supply controlling element.

2. A water heating appliance as claimed in claim 1, wherein said float switch and said tipover switch are arranged in series.

3. A water heating appliance as claimed in claim 1, wherein said float switch and said tipover switch are arranged in parallel on said signal line and outputs of the float switch and the tipover switch are entered into said electricity supply controlling element through an AND circuit.

4. A water heating appliance as claimed in claim 3, wherein said electricity supply controlling element is operated via the AND circuit only when the float switch is ON and the contact of the tipover switch is closed.

5. A water heating appliance as claimed in claim 1, wherein said controller is a microcomputer operated at about 5, whereby the signal line is also operated at about 5 volt.

* * * * *